US008302956B2

(12) United States Patent
Matsushima et al.

(10) Patent No.: US 8,302,956 B2
(45) Date of Patent: Nov. 6, 2012

(54) SHEET FEEDING APPARATUS AND IMAGE FORMING APPARATUS WITH SEPARATION CLAW AND INTERMITTENT DRIVE

(75) Inventors: Akira Matsushima, Susono (JP); Yasuhiro Uchida, Yokohama (JP); Hirofumi Hori, Numazu (JP); Hitomi Suzuki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/844,906

(22) Filed: Jul. 28, 2010

(65) Prior Publication Data

US 2011/0024969 A1 Feb. 3, 2011

(30) Foreign Application Priority Data

Aug. 3, 2009 (JP) ..... 2009-181088

(51) Int. Cl.
*B65H 3/06* (2006.01)

(52) U.S. Cl. ..... 271/114; 271/118; 271/121; 271/170

(58) Field of Classification Search ..... 271/114, 271/118, 121, 169, 170
See application file for complete search history.

(56) References Cited

U.S. PATENT DOCUMENTS

| | | | | |
|---|---|---|---|---|
| 4,097,041 | A * | 6/1978 | Fujimoto | 271/114 |
| 4,363,477 | A * | 12/1982 | Miyashita | 271/170 |
| 5,145,164 | A * | 9/1992 | Kan | 271/170 |
| 5,168,290 | A | 12/1992 | Tanaka et al. | |
| 5,321,486 | A | 6/1994 | Nanbu et al. | |
| 5,543,908 | A | 8/1996 | Suzuki | |
| 5,547,181 | A * | 8/1996 | Underwood | 271/114 |
| 5,676,363 | A | 10/1997 | Kishida et al. | |
| 5,700,006 | A | 12/1997 | Sekiya et al. | |
| 5,738,453 | A | 4/1998 | Tsuburaya et al. | |
| 5,765,826 | A | 6/1998 | Isoda et al. | |
| 6,527,267 | B1 | 3/2003 | Kuwata et al. | |
| 6,786,481 | B2 * | 9/2004 | Kawai et al. | 271/109 |
| 6,830,245 | B2 | 12/2004 | Matsushima et al. | |
| 6,871,848 | B2 | 3/2005 | Matsushima et al. | |
| 6,997,449 | B2 | 2/2006 | Obuchi et al. | |
| 7,029,006 | B2 | 4/2006 | Izumi et al. | |
| 2007/0158895 | A1 * | 7/2007 | Hamahashi | 271/10.03 |
| 2009/0066009 | A1 | 3/2009 | Matsushima et al. | |
| 2010/0133743 | A1 | 6/2010 | Hamasaki et al. | |

FOREIGN PATENT DOCUMENTS

| | | |
|---|---|---|
| JP | 08-012115 | 1/1996 |

* cited by examiner

*Primary Examiner* — Gerald McClain
(74) *Attorney, Agent, or Firm* — Fitzpatrick, Cella, Harper & Scinto

(57) ABSTRACT

A sheet feeding apparatus, in which a drive motor rotates a pickup roller, and a drive transmission portion provided between the drive motor and the pickup roller transmits a drive from the drive motor to the pickup roller. During sheet feeding, one of the drive motor and the drive transmission portion causes the pickup roller to perform an intermittent drive of iterating the drive and a stop, so that a sheet is gradually deflected between the pickup roller and separation claws.

8 Claims, 6 Drawing Sheets

SHEET FEEDING APPARATUS AND IMAGE FORMING APPARATUS WITH SEPARATION CLAW AND INTERMITTENT DRIVE

BACKGROUND OF THE INVENTION

1. Field of the Invention

The present invention relates to a sheet feeding apparatus and an image forming apparatus, in particular, a sheet feeding apparatus and an image forming apparatus which separate sheets one by one by using a separation claw and feed the separated sheets.

2. Description of the Related Art

In recent years, an image forming apparatus such as a printer, a copying machine, and a facsimile includes a sheet feeding apparatus configured to separate sheets one by one and feeding each of the sheets to an image forming portion. As the above-mentioned sheet feeding apparatus, the following sheet feeding apparatus is known. Specifically, in the sheet feeding apparatus, a sheet containing portion includes a rising and lowering sheet supporting portion configured to support the sheets stacked thereon. The sheet supporting portion is raised up to a sheet feeding position at which the uppermost sheet of the sheets stacked on the sheet supporting portion can be fed by a feed roller. Then, the feed roller feeds the uppermost sheet.

Here, as a system of separating the sheets one by one during sheet feeding, there is known a system including separation claws configured to restrain, in a leading edge of the sheets stacked on the sheet supporting portion, both side edges in a width direction orthogonal to a sheet feeding direction of the sheets. In the separation system using separation claws, the separation claws deflect and then flick each of the sheets, which have been fed by the feed roller, so as to separate the sheets one by one. However, some types of sheets have stiffness or frictional coefficient different from each other. Therefore, timing when each of the sheets moves away from the separation claws and slipping state of the feed roller with respect to each of the sheets may be different among the sheets. In this case, feeding amount of the sheets may decrease or increase. In a case where the feeding amount of the sheets is small, the sheets cannot be separated by the separation claws. This leads to feeding failure. In a case where the feeding amount of the sheets is large, each of the sheets is incapable of climbing over the separation claws, and hence a corner(s) of each of the sheets is (are) bent. This causes damage to the sheets. With this regard, Japanese Patent Application Laid-Open No. H08-012115 discloses the following sheet feeding apparatus. Specifically, in the sheet feeding apparatus, depending on the type of sheet, positions of the separation claws and a position of the sheet supporting portion in the sheet feeding direction with respect to the feed roller are integrally changed. In this way, each of the sheets can be stably fed. Further, the above-mentioned configuration is capable of feeding even sheets such as label sheets having high frictional coefficient between the sheets and large stiffness.

However, in the above-mentioned conventional sheet feeding apparatus having the configuration of integrally changing the positions of the separation claws and the position of sheet supporting portion with respect to the feed roller, a mechanism configured to change the positions of the separation claws and the position of the sheet supporting portion is required. Further, in a case where the above-mentioned mechanism configured to change the positions is provided, it is possible to feed sheets having high frictional coefficient between the sheets and large stiffness. However, provision of the above-mentioned mechanism leads to an increase in cost and size of the sheet feeding apparatus. The increase in size of the sheet feeding apparatus occurs because space is required for moving the separation claws and the sheet supporting portion. Further, a user needs to change setting depending on the type of the sheets, and hence there is a problem of taking labor hour for setting.

SUMMARY OF THE INVENTION

The present invention has been made in view of the above-mentioned circumstances, and therefore, it is an object of the present invention to provide a sheet feeding apparatus capable of stably feeding sheets having a high frictional coefficient between the sheets and large stiffness, to provide an image forming apparatus including the sheet feeding apparatus, and to provide a sheet separation method for the sheet feeding apparatus.

According to the present invention, there is provided a sheet feeding apparatus, including: a feed roller configured to feed sheets supported by a sheet supporting portion; a separation claw configured to separate the sheets one by one, which have been fed by the feed roller, by restraining both side ends in a width direction orthogonal to a sheet feeding direction of leading edges of the sheets to deflect and flick each of the sheets; a drive motor configured to rotate the feed roller; and a drive transmission portion provided between the drive motor and the feed roller, and configured to transmit a drive from the drive motor to the feed roller, wherein one of the drive motor and the drive transmission portion causes the feed roller to perform an intermittent drive of iterating the drive and a stop, during sheet feeding.

Further features of the present invention will become apparent from the following description of exemplary embodiments with reference to the attached drawings.

DESCRIPTION OF THE EMBODIMENTS

Figure 1:
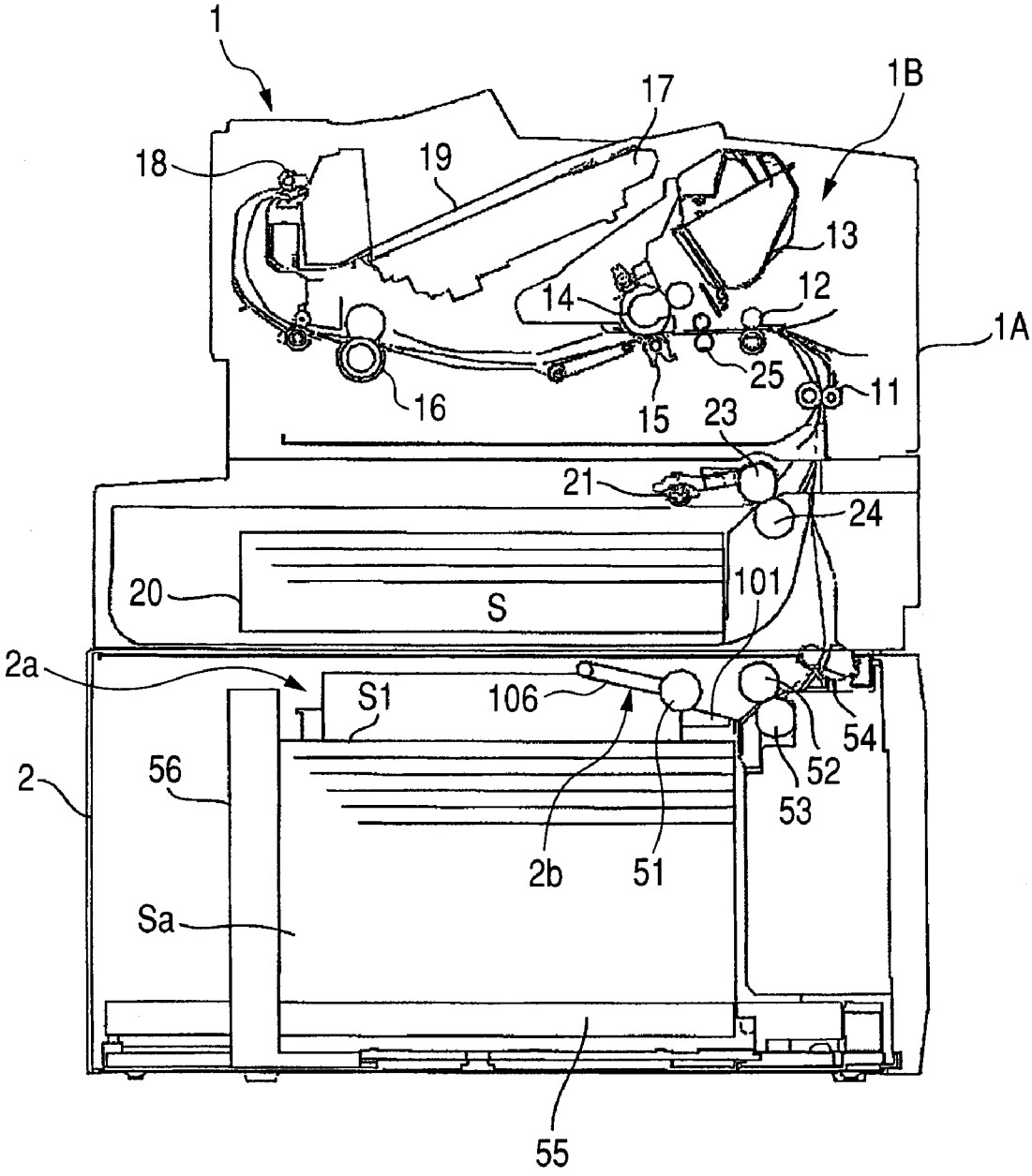
FIG. 1 is a view illustrating a schematic configuration of a laser beam printer as an example of an image forming apparatus including a sheet feeding apparatus according to an embodiment of the present invention.

A description will be provided below in detail of embodiments for implementing the present invention with reference to the accompanying drawings. FIG. 1 is a view illustrating a schematic configuration of a laser beam printer as an example of an image forming apparatus including a sheet feeding apparatus according to an embodiment of the present invention. In FIG. 1, the laser beam printer 1, a laser beam printer main body 1A (hereinafter referred to as a printer main body), and a deck-type sheet feeding apparatus 2 (hereinafter referred to as a sheet feeding deck) mounted under the printer main body 1A are illustrated. Further, an image forming portion 1B is provided in the printer main body 1A, and forms an image by an electrophotographic method. The image forming portion 1B includes: a photosensitive drum 14 configured to form a toner image; a laser exposure device 17 as a laser exposure optical system configured to irradiate the photosensitive drum 14 with a laser beam according to an image signal; a transfer roller 15 configured to transfer, to a sheet S, the toner image formed on the photosensitive drum 14. The photosensitive drum 14 is incorporated in a process cartridge 13 detachably mounted to the printer main body 1A. In a lower portion of the printer main body 1A, a cassette 20 configured to stack and contain the sheets S therein is detachably mounted to the printer main body 1A, and the sheets S contained in the cassette 20 are appropriately fed out in order from an uppermost sheet by a pickup roller 21 provided in the printer main body 1A.

In FIG. 1, a feed roller 23 is provided in the printer main body 1A, and a retard roller 24 rotates at a predetermined torque through a torque limiter (not shown) in a direction of returning the sheets conveyed by the feed roller 23. By the feed roller 23 and the retard roller 24, the sheets S fed out by the pickup roller 21 are separated and fed one by one. Pairs of conveyor rollers 11 and 12 are provided in the printer main body 1A, and the pairs of conveyor rollers 11 and 12 sequentially receive the sheet S fed by the feed roller 23, and convey the received sheet S toward a registration roller pair 25. The sheet S on which a toner image has been transferred is subjected to heating and pressing treatments at the time of passing through a fixing device 16, so that the toner image is fixed to the sheet S.

In the laser beam printer 1 configured as described above, when an image forming operation is started, first, the photosensitive drum 14 is irradiated with light according to the image signal by the laser exposure device 17, and then a latent image is formed on the photosensitive drum by such irradiation of the light according to the image signal. Next, this latent image is developed with toner contained in the process cartridge 13, to thereby form a toner image (visible image) on the photosensitive drum. In parallel with such a toner image forming operation, for example, the sheets S stacked on the cassette 20 are fed out in order from the uppermost sheet by the rotation of the pickup roller 21 provided in the printer main body 1A. After that, the sheets S are separated and conveyed one by one by a separation portion comprising the feed roller 23 and the retard roller 24.

After that, the sheet S fed by the feed roller 23 is conveyed toward the standstill registration roller pair 25 by the pairs of conveyor rollers 11 and 12, and then a leading edge of the sheet S is allowed to abut against a nip portion of the registration roller pair 25 so that a loop is formed in the sheet S, to thereby correct skew feed thereof. After that, the registration roller pair 25 starts to rotate in synchronization with the image formed on the photosensitive drum 14, to convey the sheet S to a nip portion between the photosensitive drum 14 and the transfer roller 15 opposite to the photosensitive drum 14. Further, when the sheet S is fed from the sheet feeding deck 2 configured as described later, the sheet S is also conveyed to a transfer portion comprising the photosensitive drum 14 and the transfer roller 15, by the registration roller pair 25 in synchronization with the image formed on the photosensitive drum 14. In the transfer portion, a bias is applied to the transfer roller 15, so that the toner image is transferred to the sheet S which comes from the cassette 20 or to the sheet S which comes form the sheet feeding deck 2. After that, the sheet S on which the toner image has been thus transferred is conveyed to the fixing device 16, and is pressed and heated in the fixing device 16, so that the toner image is fixed to the sheet S. After that, the sheet S is delivered by a delivery roller 18 to a delivery tray 19 provided in an upper portion of the printer main body.

The sheet feeding deck 2 includes a rising and lowering sheet stacking board 55 as a sheet supporting portion configured to support a bundle of the sheets S stacked thereon. The sheet stacking board 55 is provided to be allowed to rise and lower in a sheet storage 2*a* as a sheet containing portion configured to contain the sheets S. Further, the sheet feeding deck 2 includes a trailing edge regulating plate 56 configured to regulate positions of trailing edges of the sheets, the trailing edges being edges upstream in a sheet feeding direction of the sheet bundle Sa stacked on the sheet stacking board 55. In addition, as illustrated in FIG. 2, the sheet feeding deck 2 includes side regulating plates 57, 58 configured to regulate position in a width direction orthogonal to the sheet feeding direction of the sheet bundle Sa stacked on the sheet stacking board 55.

Further, the sheet feeding deck 2 includes a sheet feeding portion 2*b* configured to feed the uppermost sheet S1 of the sheet bundle Sa stacked on the sheet stacking board 55. The sheet feeding portion 2*b* includes a pickup roller 51 as a feed roller configured to appropriately feed sheets S1 stacked on the sheet stacking board 55, from the uppermost side. Further, the sheet feeding deck 2 includes a feed roller 52, a retard roller 53, and a conveying roller 54. The feed roller 52 and the retard roller 53 constitute a separation portion configured to separate the sheets S1, which have been fed, one by one, by the pickup roller 51 and feeding each of the sheets S1. The conveying roller 54 conveys each of the sheets S1, which have been separated by the separation portion, to the printer main body 1A.

Figure 2:
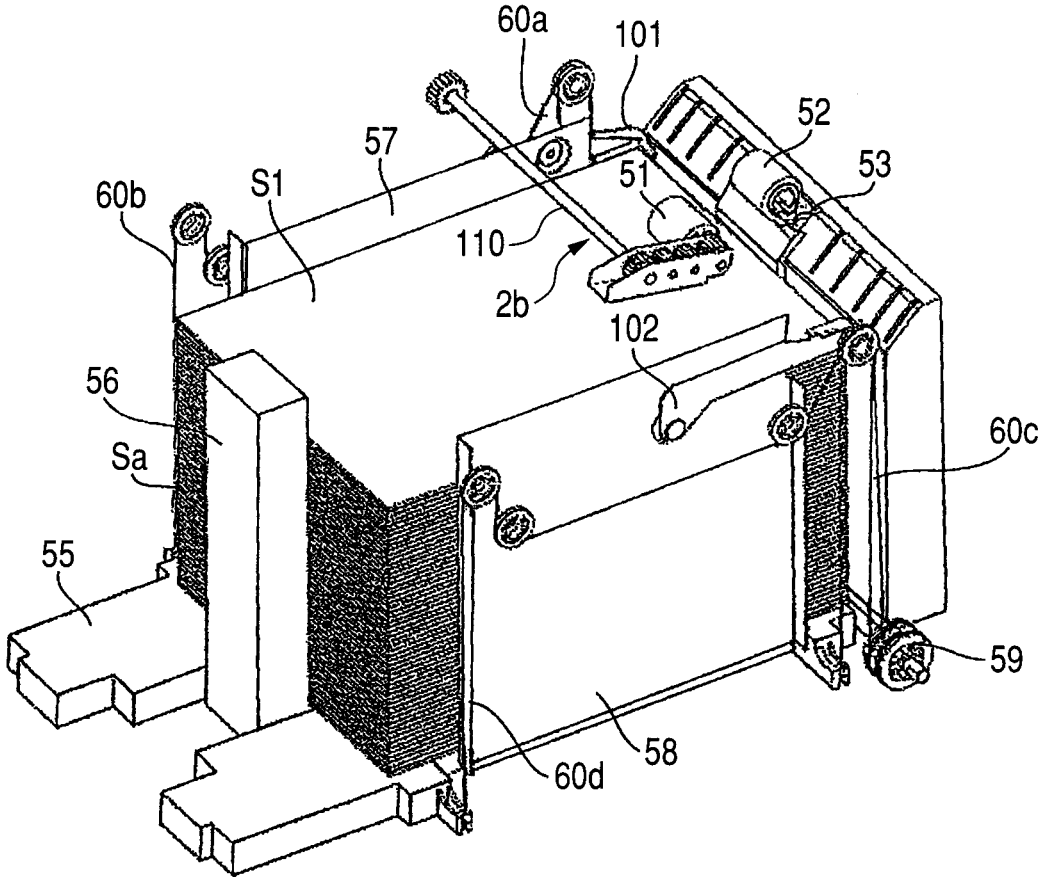
FIG. 2 is a view illustrating a raising and lowering mechanism of a sheet stacking board provided in the sheet feeding apparatus.

The sheet stacking board 55 is, as illustrated in FIG. 2, suspended through wires 60*a*, 60*b*, 60*c*, and 60*d*. The wires 60*a* to 60*d* are wound in and wound off through a wire winding shaft 59, so that the sheet stacking board 55 is moved (raised and lowered) in an up-and-down direction. When the sheet bundle Sa is stacked on the sheet stacking board 55, the wire winding shaft 59 is rotated. As a result, the wires 60*a* to 60*d* are wound in, and hence the sheet stacking board 55 is raised. Note that, the sheet stacking board 55 is controlled by a control portion (not shown) to be raised and lowered in the following manner. Specifically, the sheet stacking board 55 is moved, based on a signal from a sheet-surface detecting unit (not shown), to a position at which the uppermost sheet S1 of the stacked sheet bundle Sa is allowed to be fed by the feed roller 51. Then, the sheet stacking board 55 is controlled in the up-and-down direction so as to keep the position of an uppermost sheet S1 at the sheet feedable position.

In the sheet feeding deck 2 having the above-mentioned configuration, in a case of feeding a sheet S, the uppermost sheet S1 of the sheet bundle Sa stacked on the sheet stacking board 55 is first fed by the pickup roller 51. Then, the sheet S1 is separated and conveyed one by one by the separation portion. After that, the sheet is conveyed to the printer main body 1A by the conveying roller 54.

Figure 6:
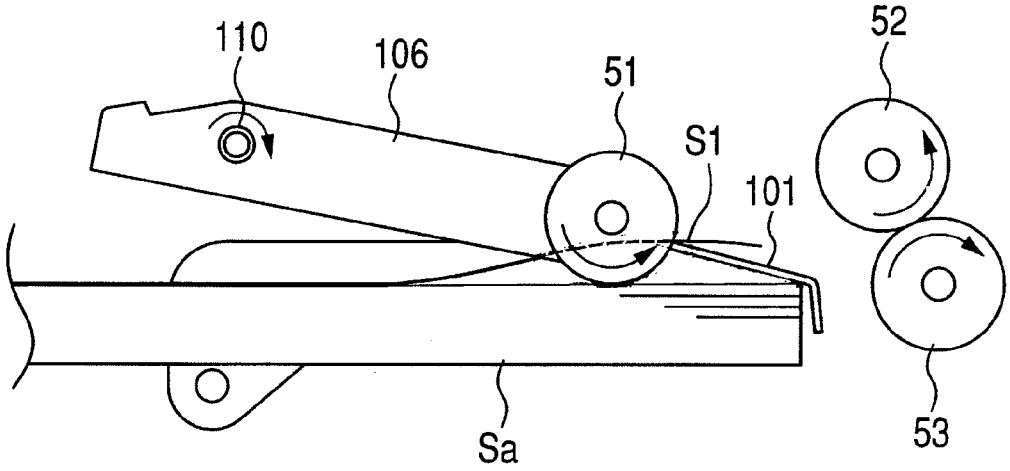
FIG. 6 is a view of a sheet climbing over a separation claw.

By the way, as illustrated in FIG. 2, the side regulating plates 57, 58 are provided with a pair of separation claws 101, 102. The pair of separation claws 101, 102 are provided to engage with both corner portions being both side ends in the width direction of the leading edges (downstream edges in the sheet feeding direction) of the sheets in the upper part of the sheet bundle Sa. The separation claws 101 and 102 utilize a deflection due to stiffness of the sheet, to thereby separate the sheets. That is, when the uppermost sheet is fed by the pickup roller 51, the both corner portions of the leading edge of the sheet are restrained. Then, the both side ends of the sheet with the leading edge thereof being restrained are deflected. When the deflection exceeds thereafter a predetermined amount, the leading edge is flicked and climbs over the separation claws 101, 102 (FIG. 6). As a result, the sheets are separated one by one. Then, as described above, the sheet S, which has been flicked from the separation claws 101, 102, is fed to the separation portion comprising the feed roller 52 and the retard roller 53.

Figure 3:
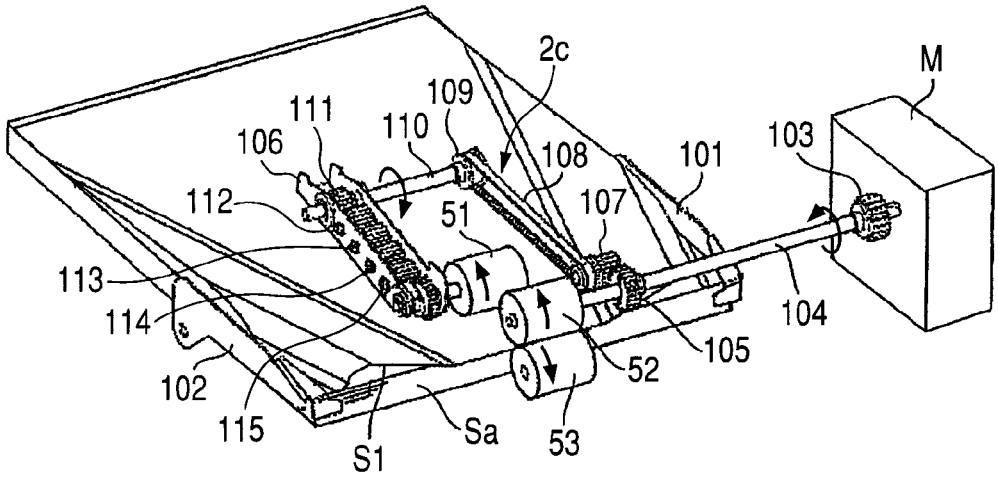
FIG. 3 is a view illustrating a configuration of a sheet feeding portion of the sheet feeding apparatus.

FIG. 3 illustrates a drive gear 103 driven by a drive motor M as a drive portion. The drive gear 103 is fixed to a feed roller shaft 104. During a feed of a sheet, the drive gear 103 is driven by the drive motor M, to thereby rotate the feed roller 52 in a direction indicated by the arrow. A drive transmission gear 105 is fixed to the feed roller shaft 104. The drive transmission gear 105 meshes with a pulley gear 107 rotatably held by frame (not shown). A rotation of the pulley gear 107 is transmitted through a timing belt 108 to a pulley 109 fixed to one end portion of a drive transmission shaft 110 rotatably held by the frame (not shown). On the other end portion of the drive transmission shaft 110, there is arranged a gear train including multiple gears 111 to 116 for driving the pickup roller 51. With this configuration, rotation of the drive motor M is transmitted to the pickup roller 51 through the drive gear 103, the feed roller shaft 104, the drive transmission gear 105, the pulley gear 107, the timing belt 108, the pulley 109, the drive transmission shaft 110, and then the gears 111 to 116. As described above, the drive transmission portion 2*c* is provided between the drive motor M and the pickup roller 51, for transmitting rotation of the drive motor M to the pickup roller 51. The drive transmission portion 2*c* includes the drive transmission gear 105, the pulley gear 107, the timing belt 108, and the gears 111 to 116.

The gears 112 to 116 and the pickup roller 51 are arranged in a pick arm 106 as an arm portion, which is rotatable about the drive transmission shaft 110 upstream of the pickup roller 51 in the sheet feeding direction. The pickup roller 51 is rotatably held at a distal end of the pick arm 106. The pickup roller 51 is downwardly rotated to come into contact with the sheet S1 by a driving force caused by the rotation of the gear 111 in a direction indicated by the arrow and the own weight of the pickup roller 51. That is, when the drive transmission shaft 110 is rotated in the direction indicated by the arrow in FIG. 3, a moment in a direction in which the pickup roller 51 is brought into pressure contact with the sheet is exerted on the pick arm 106 so that the pickup roller 51 comes into pressure contact with the sheet. As a result, the pickup roller 51 is brought into press-contact with the sheet. Then, the pickup roller 51 is rotated by the driving force caused by the rotation of the gear 111 in the direction indicated by the arrow in FIG. 3, to thereby feed out the sheet S. Note that, when the drive transmission shaft 110 is rotated in a direction opposite to the rotational direction in FIG. 3 (a rotational direction of reversing the pickup roller 51), a moment in a direction in which the pickup roller 51 is moved away from the sheet is exerted on the pick arm 106 so that the pickup roller 51 is moved away from the sheet.

With the above-mentioned configuration, a sheet feeding pressure is changed by a friction coefficient between the sheet and the pickup roller 51, and a reaction force is exerted on the pickup roller 51 in a direction reverse to the sheet feeding direction, by a reaction force caused by the sheet at the time of feeding the sheet. As the pivot point of the pick arm 106 is arranged upstream in the sheet feeding direction, a component force in the direction in which the pickup roller 51 is brought into pressure contact with the sheet is exerted on the pickup roller 51 by the reaction force exerted on the pickup roller 51. The sheet feeding pressure is determined based on the component force and the own weight of the pickup roller 51. Therefore, a force by which the pickup roller 51 is brought into pressure contact with the sheet at the time of feeding the sheets is changed depending on the friction coefficient between the sheet and the pickup roller 51. For example, for sheets S1 in which the friction coefficient thereamong is small and feeding with a small feeding force is necessary, the sheet feeding pressure is also reduced, and double feeding becomes less likely to occur. On the contrary, for sheets S1 in which the friction coefficient thereamong is large and a large feeding force is necessary, the sheet feeding pressure is also increased so that an occurrence of a feeding failure of the sheets can be prevented. As described above, the sheet feeding pressure with which the pickup roller 51 abuts against the sheet S1 is generated in such a manner that the pickup roller 51 is brought into pressure contact with the sheet S1 by the moment generated in the pick arm 106 at the time of drive transmission and the reaction force when the pickup roller 51 feeds the sheets S1.

Figure 4:
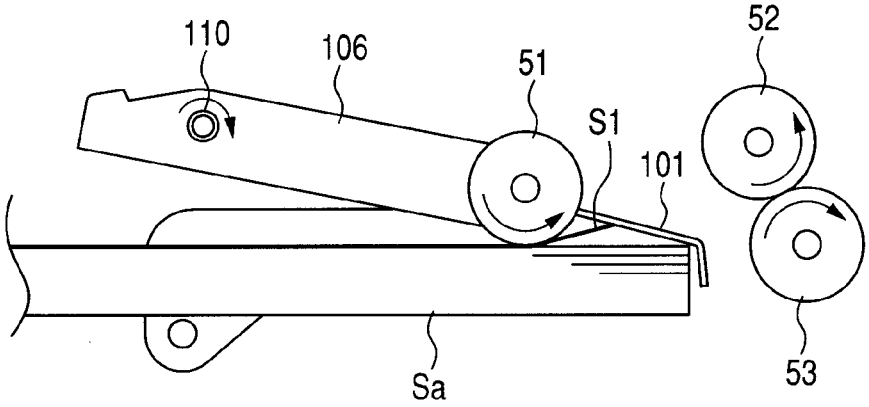
FIG. 4 is a view illustrating a state of a sheet when the sheet is slipped in the sheet feeding apparatus.
Figure 5A:
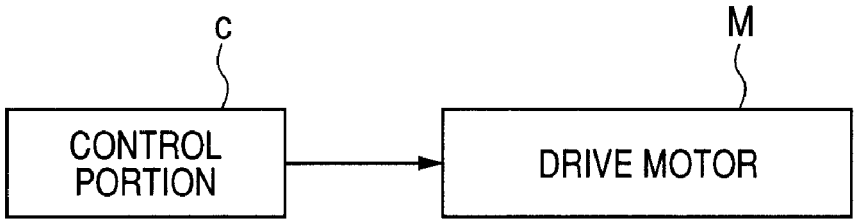
FIGS. 5A and 5B are block diagrams of drive control of intermittently driving a feed roller of the sheet feeding apparatus.
Figure 7:
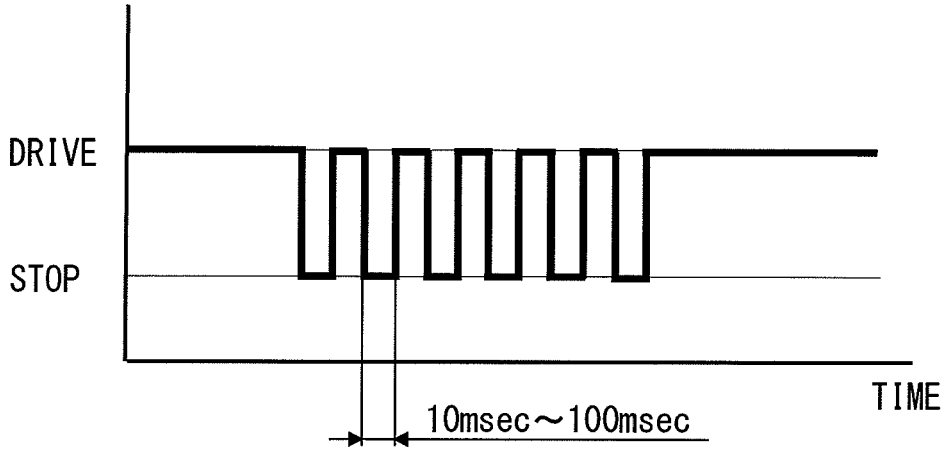
FIG. 7 is a view of showing an intermittent drive.

By the way, in the sheet feeding deck 2 having the above-mentioned configuration, for example, in a case of feeding sheets such as label sheets having substantially high frictional coefficient between the sheets and large stiffness, reliable feeding may not be performed. In a case of separating the above-mentioned sheets by the separation claws 101, 102, a large feeding resistance is exerted on the pickup roller 51 due to the frictional force between the sheets, a deflection force of the sheet S1, an impact force against the separation claws 101, 102. As a result, slipping of the sheets S1 occurs. When slipping of the sheets S1 occurs, for example, as illustrated in FIG. 4, the sheet S1 is put in a stopped state while forms deflection between the pickup roller 51 and the separation claws 101, 102. Thus, the sheet S1 cannot be flicked by the separation claws 101, 102 to climb over the separation claws 101, 102. With this regard, in this embodiment, in order to allow reliable feeding of even the sheets such as the label sheets, the following operations are iterated multiple times. Specifically, the pickup roller 51 is rotated by a certain amount, and thereafter the pickup roller 51 is stopped for a certain time period (short time period), and then is rotated again by a certain amount. Specifically, the pickup roller 51 is intermittently driven to intermittently perform sheet feeding operation. As illustrated in FIG. 5A, the drive motor M is controlled by a control portion C to be intermittently driven, to thereby intermittently drive the pickup roller 51. The above-mentioned intermittent drive is iterated, for example, at an interval of a time period of about 10 msec to about 100 msec (FIG. 7). In the intermittent drive, the stop time period may be set to be shorter than the drive time period, rather than setting the stop time period to be equal to the drive time period.

In a case of intermittently driving the pickup roller 51 as described above, the pickup roller 51 is stopped after the sheet S1 is put in a state of forming deflection. Here, when the pickup roller 51 is stopped after the sheet S1 is put in a deflected state, the sheet S1 tries to move in a direction of recovering the deflection, due to stiffness of the sheet S1. Therefore, a force rotating the pickup roller 51 in the direction opposite to the sheet feeding direction is exerted on the pickup roller 51. However, in this embodiment, when the pickup roller 51 is stopped, the pickup roller 51 is retained with a force lager than a force caused by the deflection of the sheet S1 (deflection recovery force). That is because the pickup roller 51 is coupled together with the drive transmission gear 105, the pulley gear 107, the gears 111 to 116, and the like. Specifically, when the pickup roller 51 is stopped, the drive transmission portion 2*c* does not allow the pickup roller 51 to be rotated in the direction opposite to the sheet feeding direction.

Further, in this embodiment, the drive transmission shaft 110 as a turning center of the pick arm 106 is arranged upstream of the pickup roller 51 in the sheet feeding direction. With this configuration, when the sheet S1 in the state of forming deflection tries to move in the direction of recovering the deflection, the pickup roller 51 bites in the sheet being fed. As a result, even when the sheet S1 tries to move in the above-mentioned direction, the pickup roller 51 is capable of properly reducing the deflection recovery force of the sheet S1. As described above, during the intermittent drive, when the pickup roller 51 is stopped, the pickup roller 51 is capable of keeping the slipped sheet S1 in the deflected state. Thus, when the pickup roller 51 is rotated again, the pickup roller 51 starts rotation again from the state in which the sheet S1 is deflected.

By the way, in a case of feeding the sheets by the pickup roller 51, the frictional force between the sheet and the pickup roller 51 when the sheet in the stopped state is to be fed is a static friction force. In contrast, the frictional force between the sheet and the pickup roller 51 after the sheet starts to move due to rotation of the pickup roller 51 is a dynamic friction force. Therefore, a feeding force of the pickup roller 51 exerted on the sheet upon a start of feeding is larger than a feeding force during the movement of the sheet. Specifically, the feeding force when the sheet in the stopped state is fed is larger than the feeding force when the moving sheet S1 is fed.

Therefore, even in a case of sheet slipping, the pickup roller 51 may be stopped before the pickup roller 51 is rotated again, to thereby switch the frictional force between the pickup roller 51 and the sheet from the dynamic friction force to the static friction force. Further, the frictional force between the pickup roller 51 and the sheet are switched from the dynamic friction force to the static friction force as described above, and hence it is possible to act a large feeding force with respect to the sheet in the slipped state. Thus, it is possible to feed the sheet which has been put in the stopped state because the sheet cannot be flicked by the separation claws 101, 102 to climb over the separation claws 101, 102. Specifically, through rotating the pickup roller 51 again after the pickup roller is rotated by a certain amount and stopped, it is possible to feed the sheet S1 with a large feeding force. Therefore, it is possible to feed the sheet which has been put in the stopped state because the sheet cannot be flicked by the separation claws 101, 102 to climb over the separation claws 101, 102. The above-mentioned feeding operation and a stop are iterated multiple times, to thereby reliably feed the sheets. When the fed sheet is sensed by a sheet sensor (not shown) arranged downstream of the separation portion, a drive of the pickup roller 51 is stopped and the sheet feeding operation is terminated.

As described above, in this embodiment, in the case of feeding the sheet S1, the pickup roller 51 is intermittently rotated, to thereby switch the frictional force between the sheet S1 to be fed and the pickup roller 51 from the dynamic friction force to the static friction force. The frictional force is switched to the static friction force as described above, so that, even in a case where the sheet S1 is slipped, the feeding force increases when the pickup roller is rotated again. When the above-mentioned operation is iterated, the sheet S1 is gradually deflected. As a result, even under a state in which the sheet S1 is slipped and hence the feeding resistance is large, the sheet S1 is allowed to be flicked in due time by the separation claws 101, 102 to climb over the separation claws 101, 102.

As described above, the pickup roller 51 is intermittently rotated, and hence the feeding force increases as compared to a case of feeding the sheet through continuously rotating the pickup roller 51. As a result, it is possible to feed even sheets having a high frictional coefficient between the sheets and large stiffness. Specifically, during sheet feeding, there is employed a separating method in which the pickup roller 51 is intermittently driven to iterate the drive and the stop. Thus, it is possible to stably feed even the sheets having a high frictional coefficient between the sheets and large stiffness without increasing cost and taking labor-time for setting.

Figure 5B:
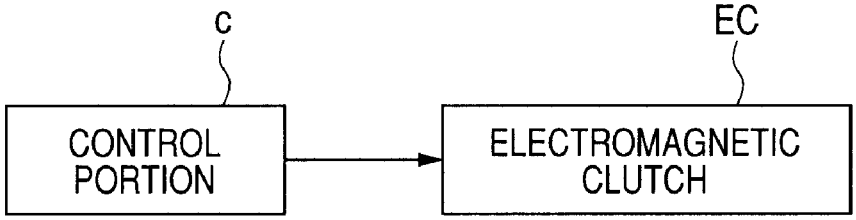

Note that, it is sufficient that an intermittent rotation number of the pickup roller 51 may be a rotation number for feeding one sheet. Further, as a configuration for intermittently rotating the pickup roller 51, in this embodiment, the rotation of the drive motor M is controlled by the control portion C illustrated in FIG. 5A, to thereby intermittently rotate the drive motor M. Alternatively, as illustrated in FIG. 5B, the drive transmission portion 2*c* may be provided with an electromagnetic clutch mechanism EC, and the electromagnetic clutch mechanism EC is set to be turned ON/OFF by the control portion C at predetermined intervals in time. Further, a partially toothless gear may be used as one of the gears constituting the drive transmission portion 2*c*, and the partially toothless gear may be used to intermittently transmit the drive of the gears through temporarily stopping the drive.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-181088, filed Aug. 3, 2009, which is hereby incorporated by reference herein in its entirety.

What is claimed is:

1. A sheet feeding apparatus, comprising:

a feed roller positioned to feed sheets supported by a sheet supporting portion;

a separation claw positioned to separate one by one the sheets, which are fed by the feed roller, by restraining both side ends in a width direction orthogonal to a sheet feeding direction of leading edges of the sheets, a deflection of a sheet fed by the feed roller being formed between the feed roller and the separation claw, whereby the deflected sheet climbs over the separation claw;

a drive motor that drives rotation of the feed roller;

a drive transmission portion positioned between the drive motor and the feed roller, and that transmits a drive force from the drive motor to the feed roller; and a control portion that controls one of the drive motor and the drive transmission portion to cause the feed roller to perform an intermittent drive of iterating the drive and a stop more than once during contact with the sheet while the sheet is deflected.

2. A sheet feeding apparatus according to claim 1, further comprising an arm portion positioned to hold the feed roller rotatably to rotate in an up-and-down direction to bring the feed roller into contact with a sheet of the sheets supported by the sheet supporting portion, wherein a rotation center of the arm portion is upstream of a position at which the feed roller is brought into contact with the sheet in the sheet feeding direction.

3. A sheet feeding apparatus according to claim 2, wherein the drive transmission portion comprises a plurality of gears provided on the arm portion.

4. A sheet feeding apparatus according to claim 1, wherein the drive motor is intermittently driven to drive the feed roller intermittently.

5. An image forming apparatus having a sheet feeding apparatus and an image forming portion which forms an image on a sheet fed by the sheet feeding apparatus, sheet feeding apparatus comprising:

a feed roller positioned to feed sheets supported by a sheet supporting portion;

a separation claw positioned to separate one by one the sheets, which are fed by the feed roller, by restraining both side ends in a width direction orthogonal to a sheet feeding direction of leading edges of the sheets, a deflection of a sheet fed by the feed roller being formed between the feed roller and the separation claw, whereby the deflected sheet climbs over the separation claw;

a drive motor that drives rotation of the feed roller;

a drive transmission portion provided between the drive motor and the feed roller, and that transmits a drive force from the drive motor to the feed roller; and a control portion that controls one of the drive motor and the drive transmission portion to cause the feed roller to perform an intermittent drive of iterating the drive and a stop more than once during contact with the sheet while the sheet is deflected.

6. An image forming apparatus according to claim 5, further comprising an arm portion configured to hold the feed roller rotatably and configured to rotate in an up-and-down direction to bring the feed roller into contact with a sheet of the sheets supported by the sheet supporting portion, wherein a rotation center of the arm portion is upstream of a position at which the feed roller is brought into contact with the sheet in the sheet feeding direction.

7. An image forming apparatus according to claim 6, wherein the drive transmission portion comprises a plurality of gears provided on the arm portion.

8. An image forming apparatus according to claim 5, wherein the drive motor is intermittently driven to drive the feed roller intermittently.

* * * * *